US010136785B2

(12) United States Patent
Gottschall et al.

(10) Patent No.: US 10,136,785 B2
(45) Date of Patent: Nov. 27, 2018

(54) VACUUM CLEANER HAVING A FILTER CLEANING MECHANISM

(71) Applicant: SHOP VAC CORPORATION, Williamsport, PA (US)

(72) Inventors: Jason Gottschall, South Williamsport, PA (US); Kurt Westbrook, Cogan Station, PA (US); Randy L. Buss, Muncy, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 153 days.

(21) Appl. No.: 15/245,432

(22) Filed: Aug. 24, 2016

(65) Prior Publication Data

US 2018/0055318 A1 Mar. 1, 2018

(51) Int. Cl.

| | |
|---|---|
| ***A47L 9/20*** | (2006.01) |
| ***A47L 9/10*** | (2006.01) |
| ***A47L 9/32*** | (2006.01) |
| ***A47L 9/12*** | (2006.01) |

(52) U.S. Cl.

CPC ..... *A47L 9/20* (2013.01); *A47L 9/102* (2013.01); *A47L 9/127* (2013.01); *A47L 9/325* (2013.01); *A47L 9/327* (2013.01)

(58) Field of Classification Search

CPC . A47L 9/20; A47L 9/102; A47L 9/325; A47L 9/127; A47L 9/327

See application file for complete search history.

(56) References Cited

U.S. PATENT DOCUMENTS 786,549 A * 4/1905 Dion ..... B01D 33/067 210/413
2,405,129 A * 8/1946 Bible ..... A47L 9/20 15/352
3,236,032 A * 2/1966 Yasukawa ..... A47L 9/20 15/352

(Continued)

FOREIGN PATENT DOCUMENTS

EP 2677916 A1 1/2014
GB 682137 A * 11/1952 ..... A47L 9/20

(Continued)

OTHER PUBLICATIONS

International Search Report and Written Opinion for Application No. PCT/US17/48363, dated Jan. 24, 2018.

(Continued)

*Primary Examiner* — Marc Carlson

(74) *Attorney, Agent, or Firm* — Marshall, Gerstein & Borun LLP

(57) ABSTRACT

A vacuum cleaner having a filter cleaning mechanism that is manually actuable while the vacuum cleaner is fully assembled is disclosed. A housing of the vacuum cleaner has an exterior side and an interior side, and a channel extends through the housing from the exterior side to the interior side. A filter brush is in contact with a side of the vacuum filter, and a rod extends slidably through the channel in the housing and is coupled to the filter brush. A handle is coupled to the rod, and movement of the handle slides the rod through the channel and moves the filter brush along the side of the vacuum filter to remove debris from the filter. The handle may be rotatable, and the filter cleaning mechanism may include a bellows or a sealing member.

15 Claims, 13 Drawing Sheets

(56) References Cited

U.S. PATENT DOCUMENTS

| | | | | |
|---|---|---|---|---|
| 4,246,011 | A * | 1/1981 | Oberdorfer | A47L 9/20 55/283 |
| 5,271,751 | A * | 12/1993 | Lagler | B01D 50/002 55/295 |
| 5,603,740 | A | 2/1997 | Roy | |
| 6,949,130 | B1 | 9/2005 | Grey et al. | |
| 7,070,636 | B2 * | 7/2006 | McCormick | A47L 9/1608 15/350 |
| 2003/0159235 | A1 * | 8/2003 | Oh | A47L 9/1666 15/352 |
| 2003/0159237 | A1 * | 8/2003 | Oh | A47L 9/20 15/352 |
| 2003/0208879 | A1 * | 11/2003 | Oh | A47L 9/1666 15/352 |
| 2005/0000055 | A1 * | 1/2005 | Cheng | A47L 9/20 15/352 |
| 2006/0283158 | A1 * | 12/2006 | Kennedy | A47L 9/20 55/300 |
| 2012/0160090 | A1 * | 6/2012 | Kato | F15B 15/1461 92/87 |
| 2014/0215752 | A1 * | 8/2014 | Loveless | A47L 9/20 15/352 |
| 2015/0251117 | A1 * | 9/2015 | Madonia | B01D 41/04 134/6 |

FOREIGN PATENT DOCUMENTS

| | | | | |
|---|---|---|---|---|
| GB | 682137 | A | 11/1952 | |
| GB | 2185545 | A * | 7/1987 | F15B 15/1433 |
| WO | WO 2014110354 | A2 * | 7/2014 | B01D 46/0067 |
| WO | WO-2014110354 | A2 | 7/2014 | |

OTHER PUBLICATIONS

International Application No. PCT/US2017/048363, Invitation to Pay Additional Fees and, Where Applicable, Protest Fee, dated Dec. 1, 2017.

* cited by examiner

VACUUM CLEANER HAVING A FILTER CLEANING MECHANISM

FIELD OF THE DISCLOSURE

This application relates generally to a vacuum having a filter cleaning mechanism and, more specifically, to a vacuum cleaner having a manually actuable filter cleaning mechanism with at least one of a rotating handle, a compressible bellows, and a seal member.

BACKGROUND

Vacuum cleaners generally include a motor which drives an air impeller to create a low pressure area inside of a tank or other receptacle. The tank has an inlet through which dust and debris or liquid material enter into the tank, usually from a hose. The incoming airstream flows through the tank and exits out one or more exhaust ports.

During dry pick-up, the dust or debris may pass into the air impeller, thereby interfering with operation of the air impeller or motor. In addition, the dust or debris may be exhausted back out into the room. To address the problems associated with the particulate-laden airstream, previous vacuum cleaners have typically included a filter for use during dry pick-up to collect the particulate material. Cylindrical or cartridge filters are often used which have large filtering surface areas and may be made of a variety of filtering materials.

The particulate matter collected by the filter may eventually result in clogging of the filter so that it must be cleaned or changed. Traditionally, a vacuum has had to be taken apart in order to access and clean a clogged filter. This process is time consuming and inconvenient. Additional developments are desirable in order to easily and effectively clean a filter without taking apart the vacuum.

SUMMARY

According to some aspects of the disclosure, a vacuum cleaner has a filter cleaning mechanism including a filter brush, a rod connected to the filter brush, and a handle coupled to the rod, wherein the handle rotates from a folded position against the exterior of the housing to an upright position. Arrangements may include a housing having an exterior side and an interior side, and a channel extending through the housing from the exterior side to the interior side. Arrangements may include a vacuum pump to draw air into the interior side of the housing and a vacuum filter disposed on the interior side of the housing to filter the air. In some arrangements, the filter brush may be contacting a side of the vacuum filter and the rod may extend slidably through the channel and may be coupled to the filter brush. In some arrangements, movement of the handle slides the rod through the channel and moves the filter brush along the side of the vacuum filter to remove debris from the filter. In some arrangements, the handle may comprise a cam to translate rotation of the handle into linear movement of the handle. In some arrangements, a seal member may surround the rod, wherein the seal member forms a seal between the rod and the channel when the handle is in the folded position and the handle pulls the rod such that the seal is disposed outside of the channel when the handle is in the upright position. In some arrangements, the handle may at least partly surround and protect the seal member when the handle is in the upright position. In some arrangements, the housing may include a cover and a lid cage joined together.

In some arrangements, another rod may extend slidably through the housing and be coupled to the filter brush, and the handle may be coupled to each of the rods. In some arrangements a brush holder may be coupled to the brush and connected to the rod by a rod retainer. The rod retainer may be quickly disconnected from the brush holder for cleaning, and the brush may then be disconnected from the brush holder for cleaning. In some arrangements, in order to disconnect the rod retainer from the brush holder, the brush holder can be rotated around the filter to cause the connection between the rod retainer and the brush holder to become disengaged. In some arrangements, the rod retainer may include clamping arms that connect to an outer surface of a projection of the brush holder. In some arrangements, the clamping arms may each have a curved portion that is complementary to the side of the projection of the brush holder.

According to some aspects of the disclosure, a vacuum cleaner has a filter cleaning mechanism including a filter brush, a rod connected to the filter brush, and a bellows that surrounds the rod, the bellows compressible from an extended configuration to a compressed configuration, and linear movement of the rod may move the bellows between the extended configuration and the compressed configuration. Arrangements may include a housing having an exterior side and an interior side, and a channel extending through the housing from the exterior side to the interior side. Arrangements may include a vacuum pump to draw air into the interior side of the housing and a vacuum filter disposed on the interior side of the housing to filter the air. In some arrangements, the filter brush may be contacting a side of the vacuum filter and the rod may extend slidably through the channel and may be coupled to the filter brush such that linear movement of the rod through the channel moves the filter brush along the side of the vacuum filter to remove debris from the side of the filter. In some arrangements, linear movement of the rod that moves the bellows between the extended configuration and the compressed configuration may occur through the channel. In some arrangements, linear movement of the rod through the channel in a first direction may move the bellows from the extended configuration to the compressed configuration and linear movement of the rod through the channel in a second direction may move the bellows from the compressed configuration to the extended configuration. The movement of the bellows between the compressed and extended configurations may prevent the accumulation of debris on the rod. In some arrangements a brush holder may be coupled to the brush and connected to the rod by a rod retainer. The rod retainer may be quickly disconnected from the brush holder for cleaning, and the brush may then be disconnected from the brush holder for cleaning. In some arrangements, in order to disconnect the rod retainer from the brush holder, the brush holder can be rotated around the filter to cause the connection between the rod retainer and the brush holder to become disengaged. In some arrangements, the rod retainer may include clamping arms that connect to an outer surface of a projection of the brush holder. In some arrangements, the clamping arms may each have a curved portion that is complementary to the side of the projection of the brush holder.

According to some aspects of the disclosure, a vacuum cleaner has a filter cleaning mechanism in which a rod may extend slidably through a housing and may be coupled to a filter brush such that linear movement of a handle coupled to the filter brush slides the rod through a channel and moves the filter brush along the side of a vacuum filter to remove debris from the side of the filter, and a seal member may form a sliding seal between the channel and the rod. Arrangements may include a housing having an exterior side and an interior side, and the channel may extend through the housing from the exterior side to the interior side. Arrangements may include a vacuum pump to draw air into the interior side of the housing, and the vacuum filter may be disposed on the interior side of the housing to filter the air. In some arrangements, the filter brush may be contacting a side of the vacuum filter. In some arrangements, the seal member may comprise an o-ring. In some arrangements, a handle may be coupled to the rod. The handle may be rotatable from a folded position against the exterior side of the housing to an upright position. The handle may cover the o-ring when the handle is in the upright position. In some arrangements, the seal to seal the channel may be formed between an interior side of the channel and the o-ring. In some arrangements a brush holder may be coupled to the brush and connected to the rod by a rod retainer. The rod retainer may be quickly disconnected from the brush holder for cleaning, and the brush may then be disconnected from the brush holder for cleaning. In some arrangements, in order to disconnect the rod retainer from the brush holder, the brush holder can be rotated around the filter to cause the connection between the rod retainer and the brush holder to become disengaged. In some arrangements, the rod retainer may include clamping arms that connect to an outer surface of a projection of the brush holder. In some arrangements, the clamping arms may each have a curved portion that is complementary to the side of the projection of the brush holder.

According to some aspects of the disclosure, a vacuum cleaner has a filter cleaning mechanism and includes a housing having an exterior side and an interior side, a channel extending through the housing from the exterior side to the interior side, a rod extending slidably through the channel, and a rod wiper attached to a wiper holder attached to the interior side of the housing in the channel such that linear movement of the rod through the channel cleans the rod. Arrangements may include a vacuum pump to draw air into the interior side of the housing, and a vacuum filter may be disposed on the interior side of the housing to filter the air. Arrangements may include a filter brush contacting a side of the vacuum filter. In some arrangements, the rod may be coupled to the filter brush such that linear movement of the rod through the channel moves the filter brush along the side of the vacuum filter to remove debris from the side of the filter. In some arrangements, the housing may comprise a lid cage and the wiper holder may be attached to the lid cage. In some arrangements, the rod wiper may comprise at least one of felt and rubber. In some arrangements a brush holder may be coupled to the brush and connected to the rod by a rod retainer. The rod retainer may be quickly disconnected from the brush holder for cleaning, and the brush may then be disconnected from the brush holder for cleaning. In some arrangements, in order to disconnect the rod retainer from the brush holder, the brush holder can be rotated around the filter to cause the connection between the rod retainer and the brush holder to become disengaged. In some arrangements, the rod retainer may include clamping arms that connect to an outer surface of a projection of the brush holder. In some arrangements, the clamping arms may each have a curved portion that is complementary to the side of the projection of the brush holder.

BRIEF DESCRIPTION OF THE DRAWINGS

While the specification concludes with claims particularly pointing out and distinctly claiming the subject matter that is regarded as the present disclosure, it is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary arrangements, except as may be explicitly delineated in the corresponding written description. None of the drawings are necessarily to scale.

DETAILED DESCRIPTION OF THE DRAWINGS

Aspects of the present disclosure are directed to a vacuum having a filter cleaning mechanism that is manually actuable while the vacuum is fully assembled. In some arrangements, a housing may have an exterior side and an interior side, and a channel may extend through the housing from the exterior side to the interior side. A vacuum pump may draw air into the interior side of the housing, and a vacuum filter may be disposed on the interior side of the housing to filter the air. A filter brush may be in contact with a side of the vacuum filter, and a rod may extend slidably through the channel in the housing. Movement of the handle may slide the rod through the channel and move the filter brush along the side of the vacuum filter to remove debris from the filter.

In some arrangements, the handle can be rotated from a folded position against the exterior side of the housing to an upright position. The handle may include a cam to translate rotation of the handle into linear movement of the handle. In some arrangements, a seal member may surround the rod and form a seal between the rod and the channel when the handle is in the folded position. The handle may pull the rod such that the seal is disposed outside of the channel when the handle is in the upright position. The handle may at least partly surround and protect the seal member when the handle is in the upright position. The housing may include a cover and lid cage joined together. In some arrangements, a second rod may extend through the housing and be coupled to the filter brush, and the handle may be coupled to both rods.

In some arrangements, a bellows surrounds the rod. The bellows may be compressible from an extended configuration to a compressed configuration, and linear movement of the rod through the channel may move the bellows between the extended configuration and the compressed configuration. A brush holder may be coupled to the rod and the brush. Linear movement of the rod through the channel in a first direction may move the bellows from the extended configuration to the compressed configuration, and linear movement of the rod through the channel in a second direction may move the bellows from the compressed configuration to the extended configuration. The linear movement of the rod in either direction keeps dirt and debris from accumulating on the rod. A bellows is not necessary in all arrangements.

In some arrangements, a seal member may form a sliding seal between the channel and the rod. The seal member may include an o-ring or another form of seal member. A handle may be coupled to the rod such that the handle is rotatable from a folded position against the exterior side of the housing to an upright position, and the handle may cover the o-ring when the handle is in the upright position. The seal to seal the channel may be formed between an interior side of the channel and the o-ring.

Figure 1:
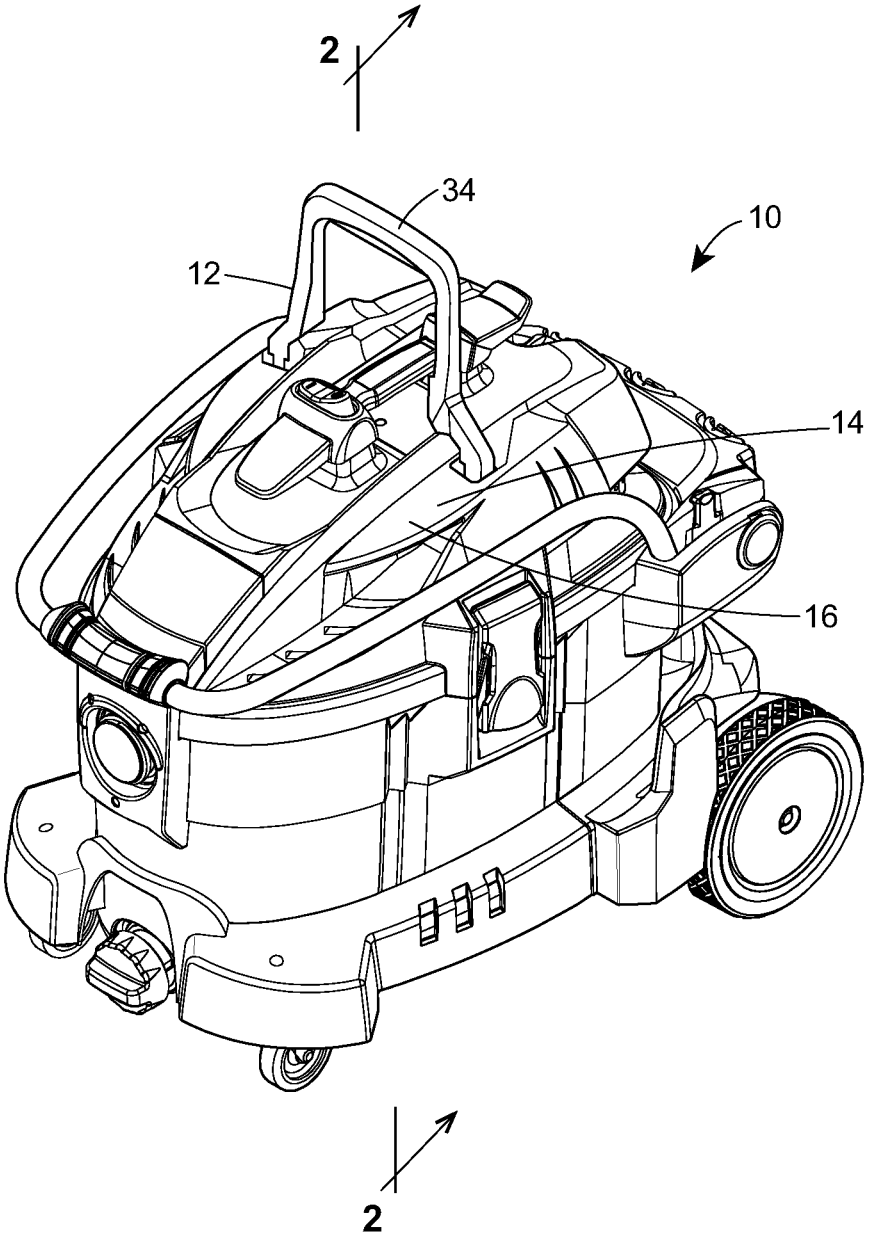
FIG. 1 is a front isometric view of a vacuum cleaner having a first embodiment of a filter cleaning mechanism of the present disclosure with a handle in a non-lifted position.

Referring now to the exemplary arrangement shown in the drawings, FIG. 1 shows a vacuum cleaner 10 having a first embodiment of a filter cleaning mechanism 12 according to the present disclosure. The vacuum cleaner 10 includes a housing 14 defining an interior side 18 (shown in FIG. 2) and an exterior side 16. The vacuum cleaner 10 in this exemplary arrangement includes various additional features, such as the casters and the push handle, that are well understood in the art and are not further described herein. The specific shape, form, and arrangement of the vacuum cleaner 10 may vary, and a filter cleaning mechanism 12 may be adapted for various other shapes, forms, and arrangements of the vacuum cleaner 10.

Figure 2:
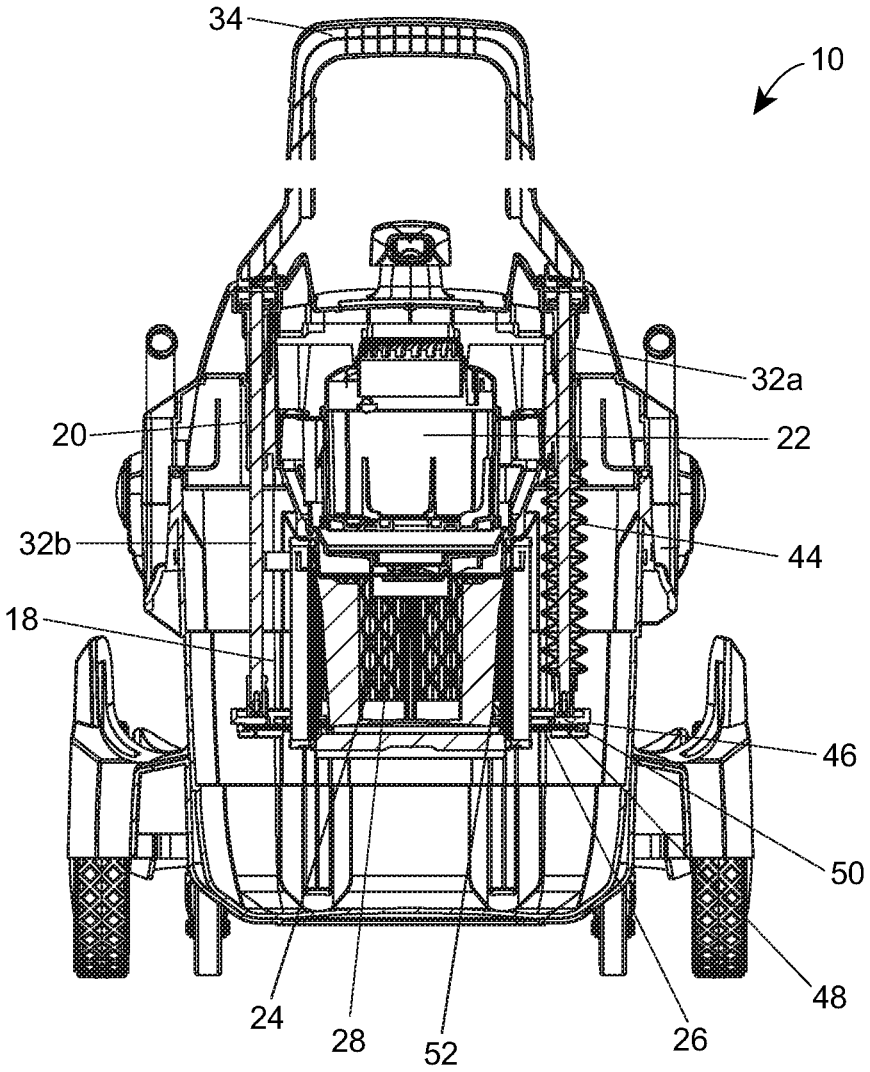
FIG. 2 is a cross-sectional view of the vacuum cleaner along the lines 2-2 of FIG. 1 illustrating a rod, bellows, brush holder, and brush of the first embodiment of the filter cleaning mechanism when the handle is in a non-lifted position.
Figure 3:
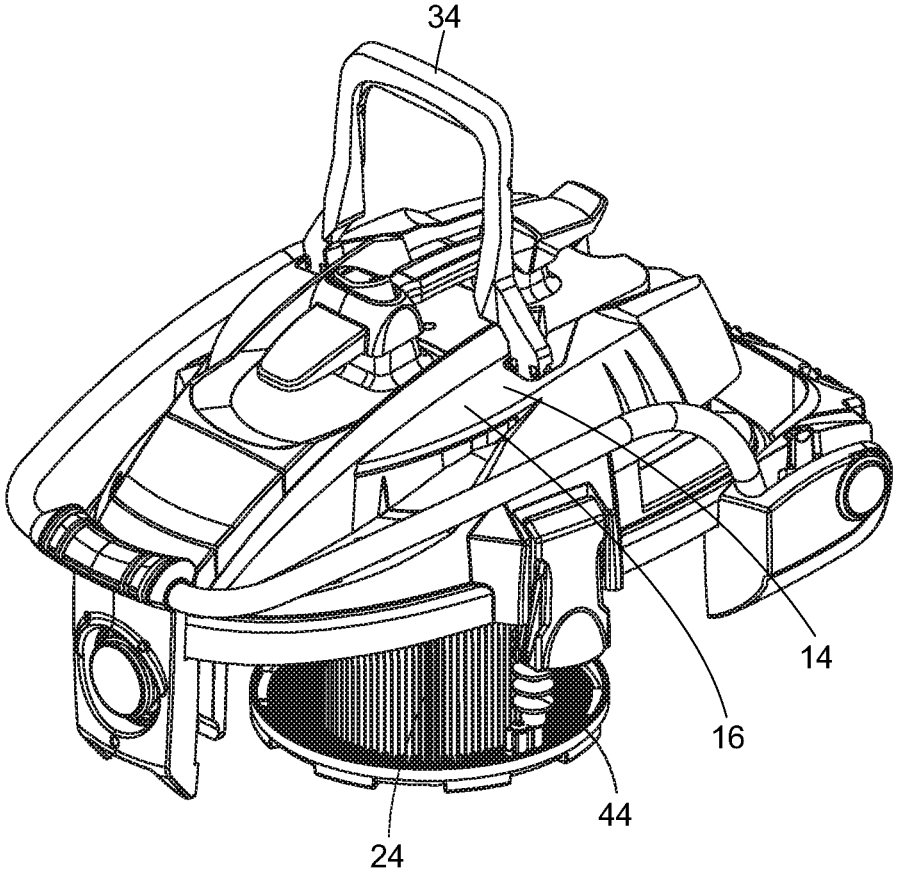
FIG. 3 is a front isometric view of a top portion of the vacuum cleaner having the first embodiment of the filter cleaning mechanism with the handle in a non-lifted position.

As better seen in FIGS. 2 and 3, the vacuum cleaner 10 having a first embodiment of a filter cleaning mechanism 12 (labeled in FIG. 1) includes a vacuum pump 22. The vacuum pump 22 is disposed on the interior side 18 of the housing 14. The vacuum pump 22 is configured to create a vacuum when turned on so as to draw a stream of air into the interior side of the housing and thereby draw debris and/or liquids into the interior the housing in a manner well understood in the art.

A vacuum filter 24 is disposed on the interior side of the housing 14. The vacuum filter 24 is configured to filter dust and debris that are drawn into the interior side 18 of the housing 14 out of the airstream before the air is exhausted back to the exterior side 16 of the housing 14. In this arrangement, the vacuum filter 24 has a generally cylindrical shape and hangs vertically downwardly from a top portion of the interior side of the housing 14. Also in this arrangement, the vacuum filter 24 hangs directly below the vacuum pump 22. However, other arrangements and locations for the vacuum filter 24 are possible.

Figure 4:
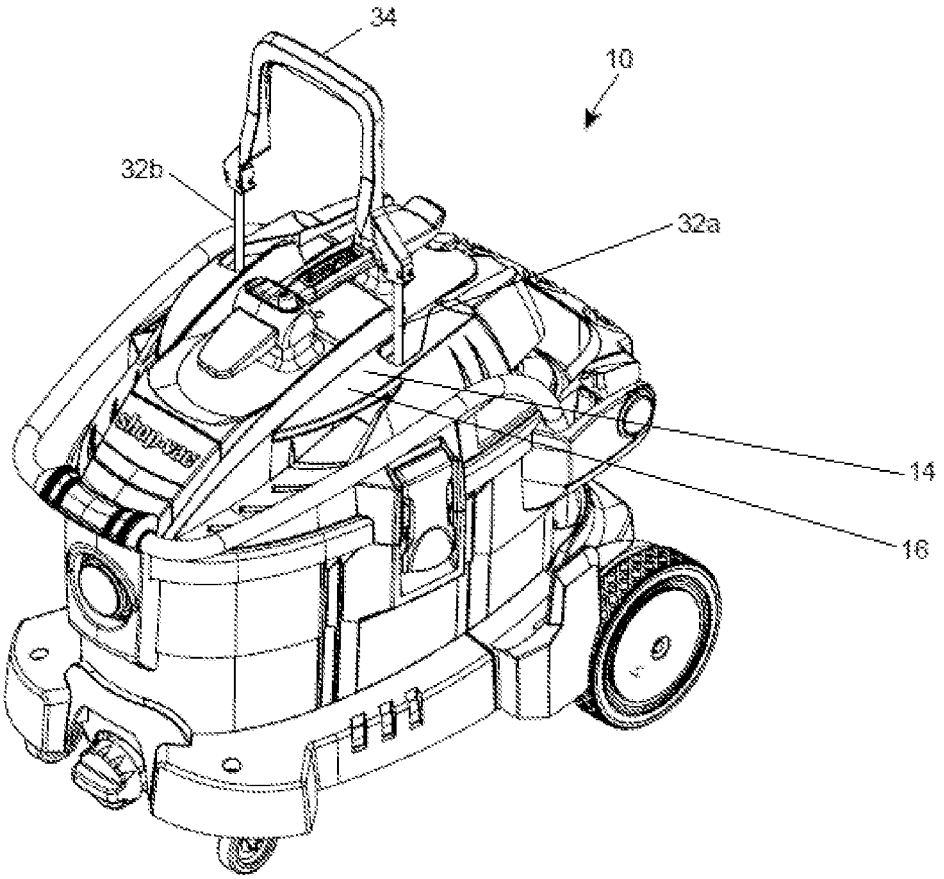
FIG. 4 is a front isometric view of the vacuum cleaner having the first embodiment of the filter cleaning mechanism of FIGS. 1-3 when the handle is in a lifted position.
Figure 5:
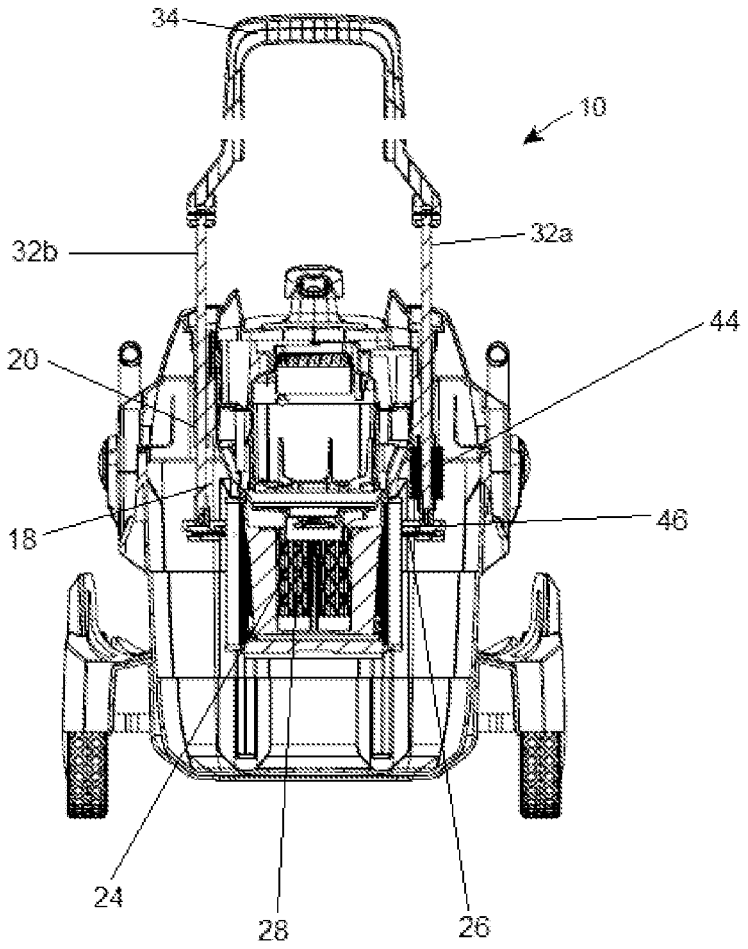
FIG. 5 is a cross-sectional view of the vacuum cleaner along the lines 2-2 of FIG. 1 illustrating the rod, bellows, brush holder, and brush of the first embodiment of the filter cleaning mechanism when the handle is in a lifted position.

The filter cleaning mechanism 12 includes a filter brush 26, a first rod 32*a* and a second rod 32*b*, and a handle 34. Each rod 32*a* and 32*b* extends through a channel 20 through the housing 14 from the interior side to the exterior side. Each rod 32*a* and 32*b* thereby has a lower end disposed inside the housing 14 and an upper end disposed on the exterior side of the housing. The filter brush 26 is coupled to each rod 32*a* and 32*b* at or near the lower end on the interior side 18 of the housing 14 such that the filter brush 26 contacts the side of the vacuum filter 24. The handle 34 is attached to the top end of each rod 32*a* and 32*b*. Each rod 32*a* and 32*b* slides axially up and down (as seen in the drawings) in its respective channel 20 so that movement of the handle 34 up and down slides the rods up and down in the respective channels, and correspondingly moves the filter brush 26 up and down along the exterior side of the vacuum filter 24 in order to remove debris from the vacuum filter 24. For example, FIGS. 1-3 show the handle 34 in a lowered position against the exterior side 16 of the housing 14. In this position, the rods 32*a*, 32*b* are pushed down through the channels 20 and the filter brush 26 is pushed down near the bottom in of the vacuum filter 24. In contrast, FIGS. 4 and 5 show the handle 34 of the first embodiment of a filter cleaning mechanism 12 in a lifted position spaced above the exterior side 16 of the housing 14. In this position, the rods 32*a* and 32*b* are pulled up through the channels 20, and the filter brush 26 is pulled up near the upper end of the vacuum filter 24. Thus, by reciprocating the handle 34 up and down, a user can easily brush away dirt and debris from the exterior side of the vacuum filter 24.

As shown in FIGS. 2, 3, and 5, the filter cleaning mechanism 12 includes a bellows 44. The bellows 44 is made from a pleated, flexible material and completely surrounds rod 32*a*. The bellows 44 is depicted in an extended configuration in FIG. 2 in which the length of the bellows 44 along the rod 32*a* is at a maximum. The bellows 44 is depicted in a compressed configuration in FIG. 5, in which the bellows 44 is compressed to a minimum length along the rod 32*a* that is less than the maximum depicted in FIG. 2. The movement of the bellows between the extended and compressed configurations as the rod 32*a* is moved prevents accumulation of debris on the rod 32*a*.

Linear movement of the rod 32*a* in a first direction moves the bellows 44 from the extended configuration, in which the length of the bellows 44 is at a maximum, to the compressed configuration, in which the length of the bellows 44 is at a minimum. Linear movement of the rod 32*b* in a second direction moves the bellows 44 from the compressed configuration, in which the length of the bellows 44 is at a minimum, to the extended configuration. Although only depicted in the first embodiment of the filter cleaning mechanism 12, a bellows may be included in the second and third embodiments disclosed herein.

Figure 6A:
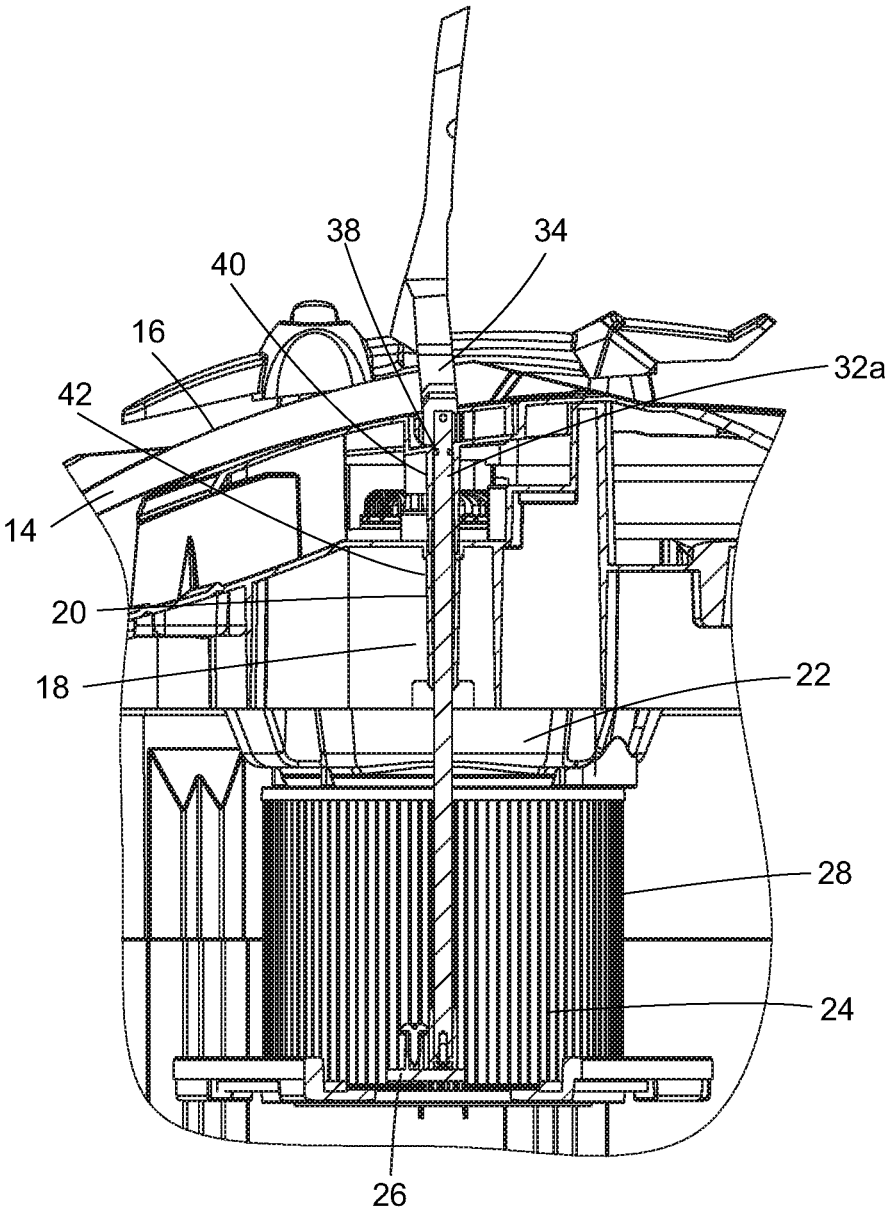
FIG. 6A is a partial, enlarged cross-sectional view of a second embodiment of a filter cleaning mechanism with the handle in an upright position covering a seal member.

In a second embodiment of a filter cleaning mechanism 12, shown in FIGS. 6A-7B, the handle 34 may comprise a cam 36 to translate rotation of the handle into linear movement of the handle 34. The cam 36 may be a curved surface at the end of the handle 34 that connects to the rod 32. A seal member 38 may surround the rod 32 to form a seal between the rod 32 and the channel 20 under certain conditions, such as when the handle 34 is in a folded position. In FIGS. 6A and 6B, the handle 34 is depicted in the upright position and the seal 38 is disposed outside of the channel 20. The handle 34 surrounds and protects the seal member 38 in the upright position, preventing the seal member 38 from falling off the rod 32. In contrast, in FIGS. 7A and 7B, the handle 34 is depicted in the folded position, and the seal member 38 forms a seal between the rod 32 and the channel 20. The seal member 38 slides between the interior wall of the channel 20 and the rod 32 and prevents debris from sliding down the gap between the rod 32 and the channel 20, which would otherwise potentially interfere with operation of the filter cleaning mechanism 12. The seal member 38 includes an o-ring 54 that is inserted into a groove in the rod 32, and the handle 34 covers the o-ring 54 when the handle 34 is in the upright position. The seal to seal the channel 20 is formed between an interior side of the channel 20 and the o-ring 54. The first and third embodiments described herein may have handles 34 comprising cams 36, seal members 38, and/or o-rings 54 as described with respect to the second embodiment.

Figure 6B:
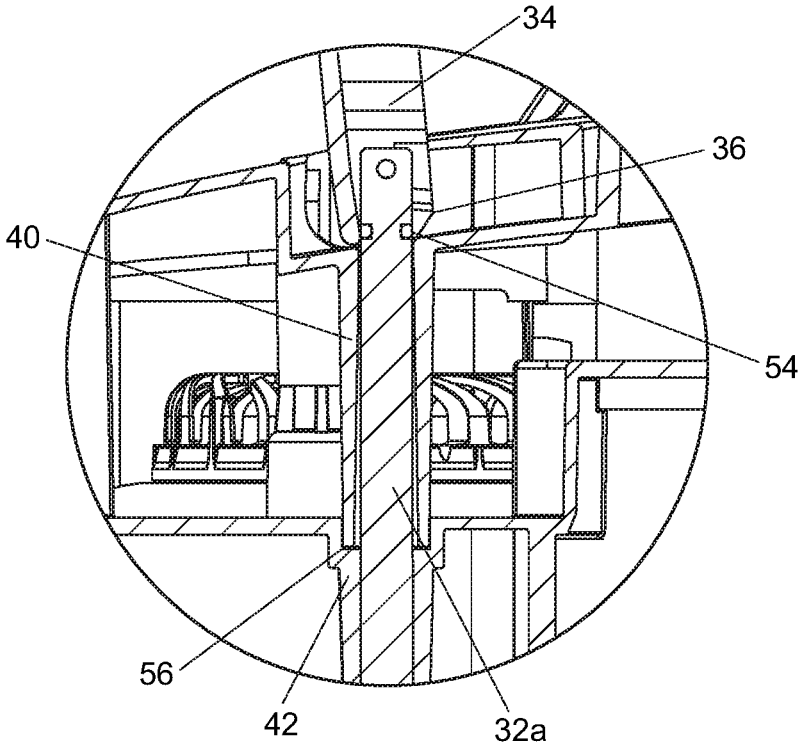
FIG. 6B is an enlarged cross-sectional view of the second embodiment of a filter cleaning mechanism of FIG. 6A.
Figure 7A:
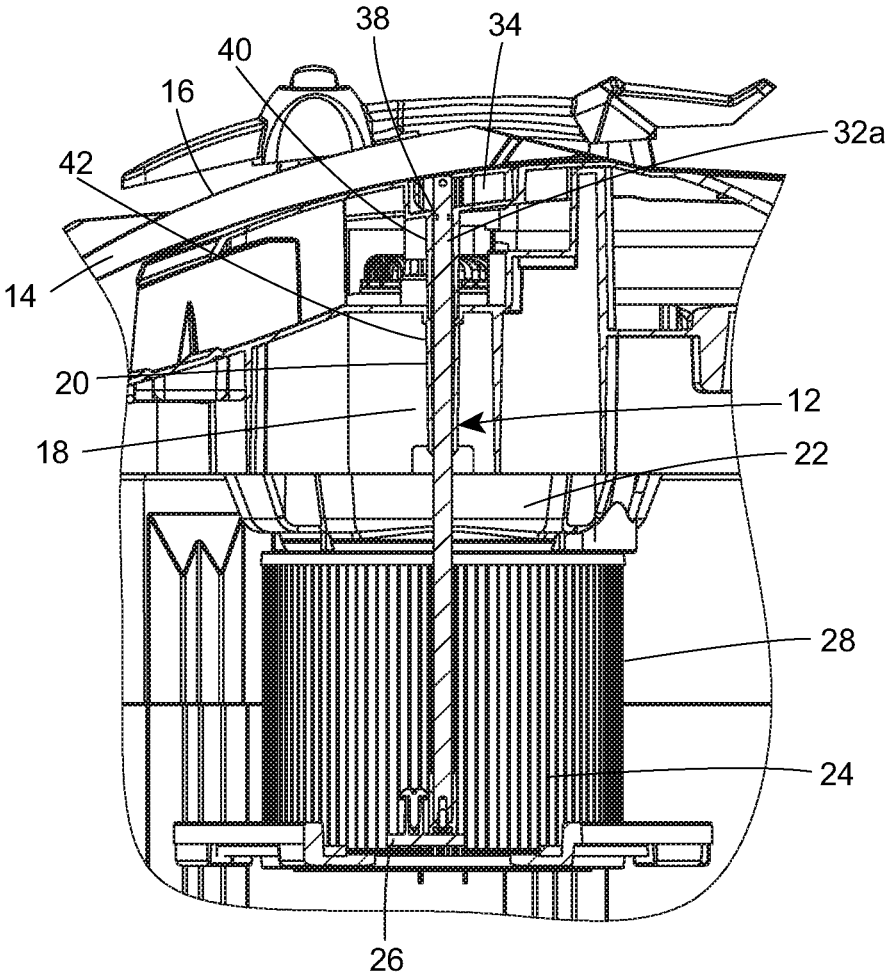
FIG. 7A is a cross-sectional view of the second embodiment of a filter cleaning mechanism similar to that depicted in FIG. 6A but when the handle is in a folded position.
Figure 7B:
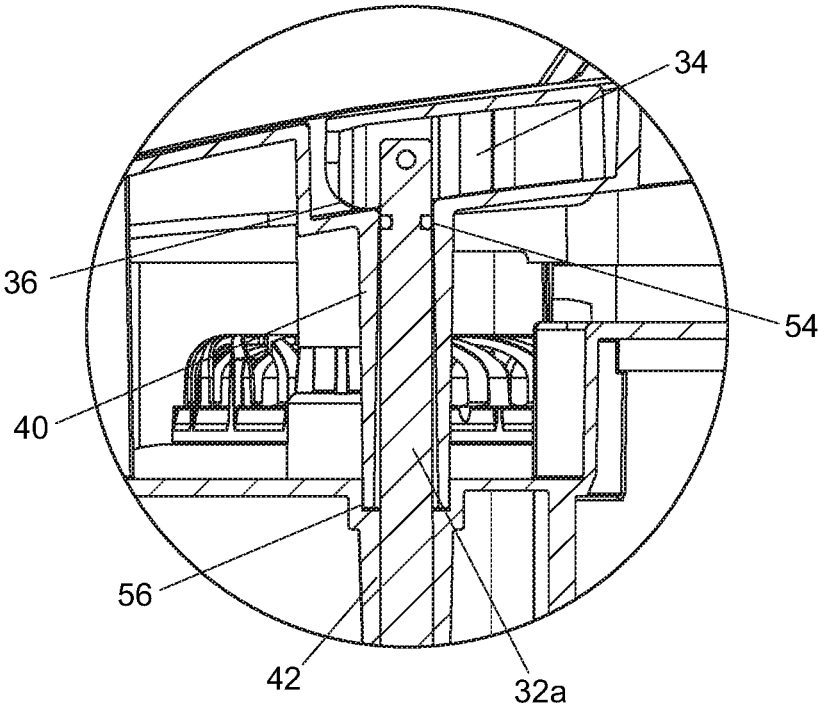
FIG. 7B is an enlarged cross-sectional view of the second embodiment of a filter cleaning mechanism of FIG. 7A.

FIGS. 6B and 7B also depict a cover 40 meeting a lid cage 42 at a joint 56. In some arrangements, the lower portion of the channel 20 may be formed in the lid cage 40, and the upper portion of the channel 20 may be formed in an annular extension of the cover 40. The lid cage 42 may have an annular notch that accommodates the side and bottom of the annular extension of the cover 40 that surrounds the channel 20, and the joint 56 may be formed by press fitting the annular extension of the cover 40 into the annular notch of the lid cage 40. Joint 56 is just one instance of a location in which various portions of the housing 14 may meet.

Figure 8A:
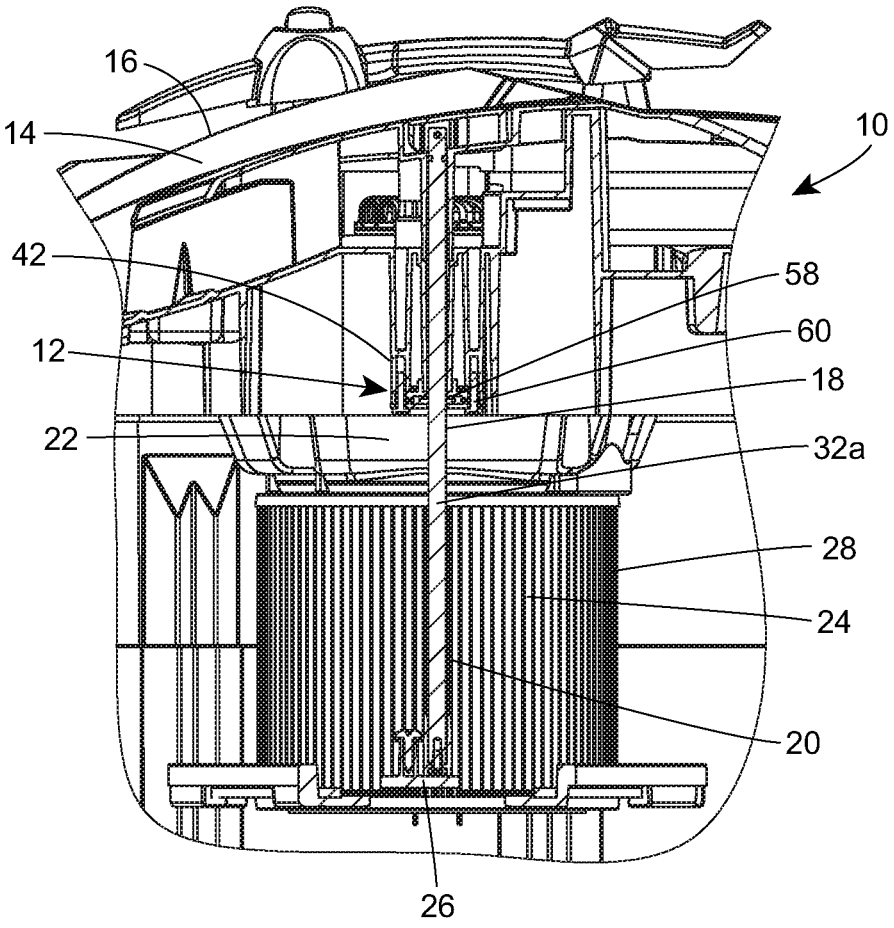
FIG. 8A is a partial, enlarged cross-sectional view of a vacuum cleaner having a third embodiment of a filter cleaning mechanism of the present disclosure with a rod wiper and wiper holder depicted in a channel of a housing of the vacuum cleaner.
Figure 8B:
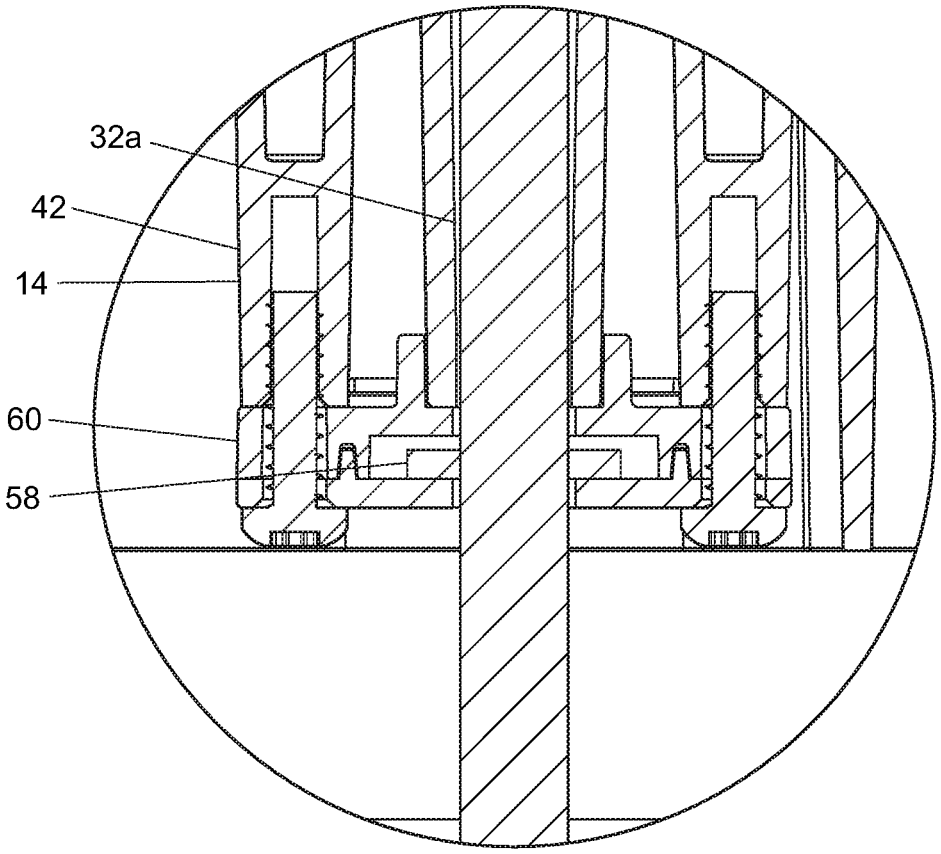
FIG. 8B is an enlarged cross-sectional view of the third embodiment of a filter cleaning mechanism of 8A.

As seen in FIGS. 8A and 8B, in the third embodiment of a filter cleaning mechanism 12, a rod wiper 58 is attached to a wiper holder 60 attached to the interior side 18 of the housing 14 in the channel 20. The rod wiper 58 keeps the rod 32*a* clean by wiping debris from the outer surface of the rod. The rod wiper 58 surrounds the rod 32*a* and is in light contact with the rod 32*a*. As the rod 32*a* is moved up and down, contact between the rod wiper 58 and the rod 32*a* removes debris stuck to the side of the rod 32*a*. In FIGS. 8A and 8B, the rod wiper and wiper holder 60 are positioned within the portion of the channel 20 that is above the vacuum filter 24. The rod wiper 58 may be made from a material such as felt or rubber that will grab debris easily. A similar rod wiper 58 may be similarly provided for the rod 32*b*. The first and second embodiments described herein may have a rod wiper 58 and wiper holder 60 as described with respect to the third embodiment.

Figure 9A:
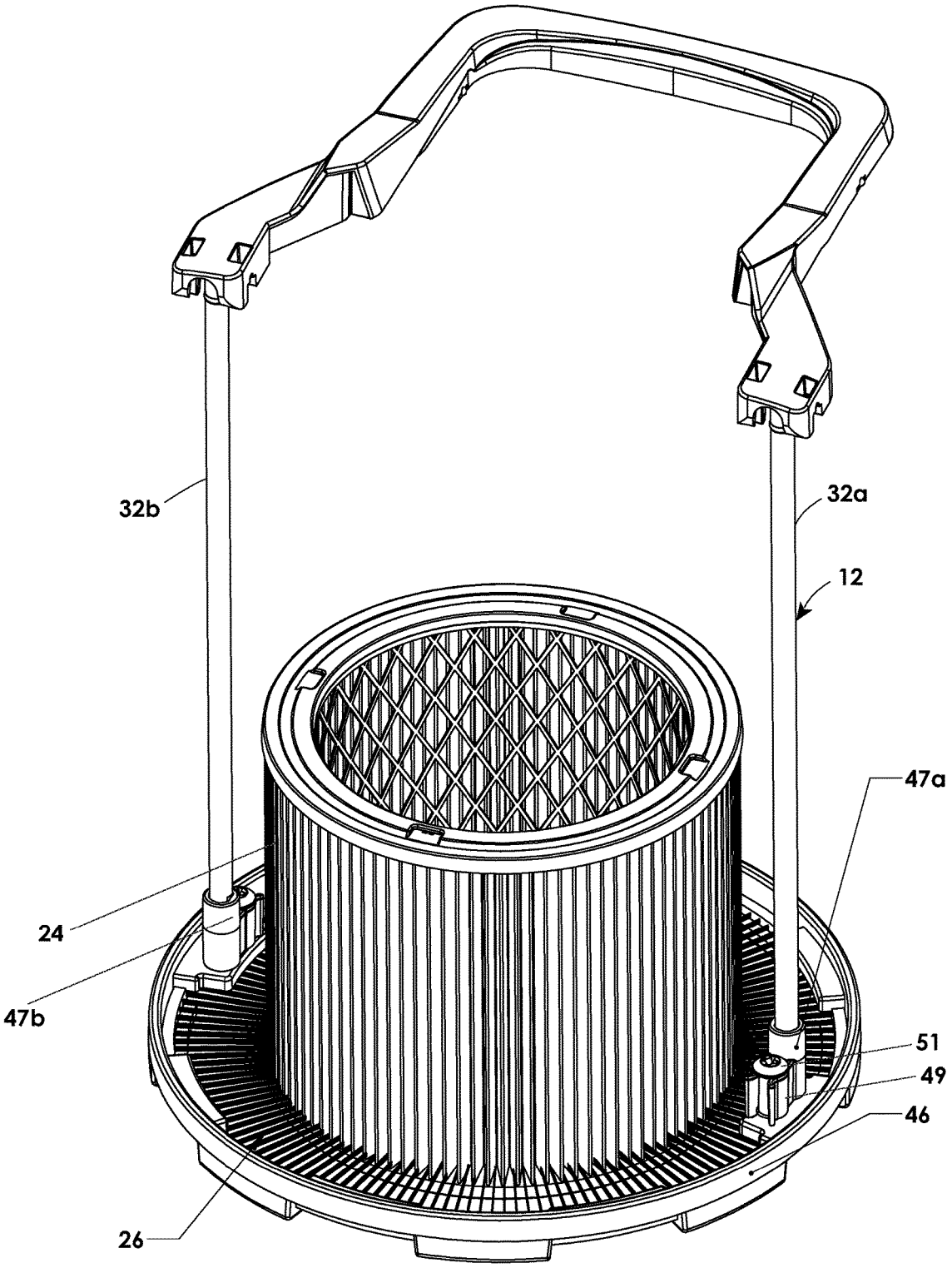
FIG. 9A is an isometric view of a filter cleaning mechanism having rods connectable to a filter brush by rod retainers in a connected configuration.
Figure 9B:
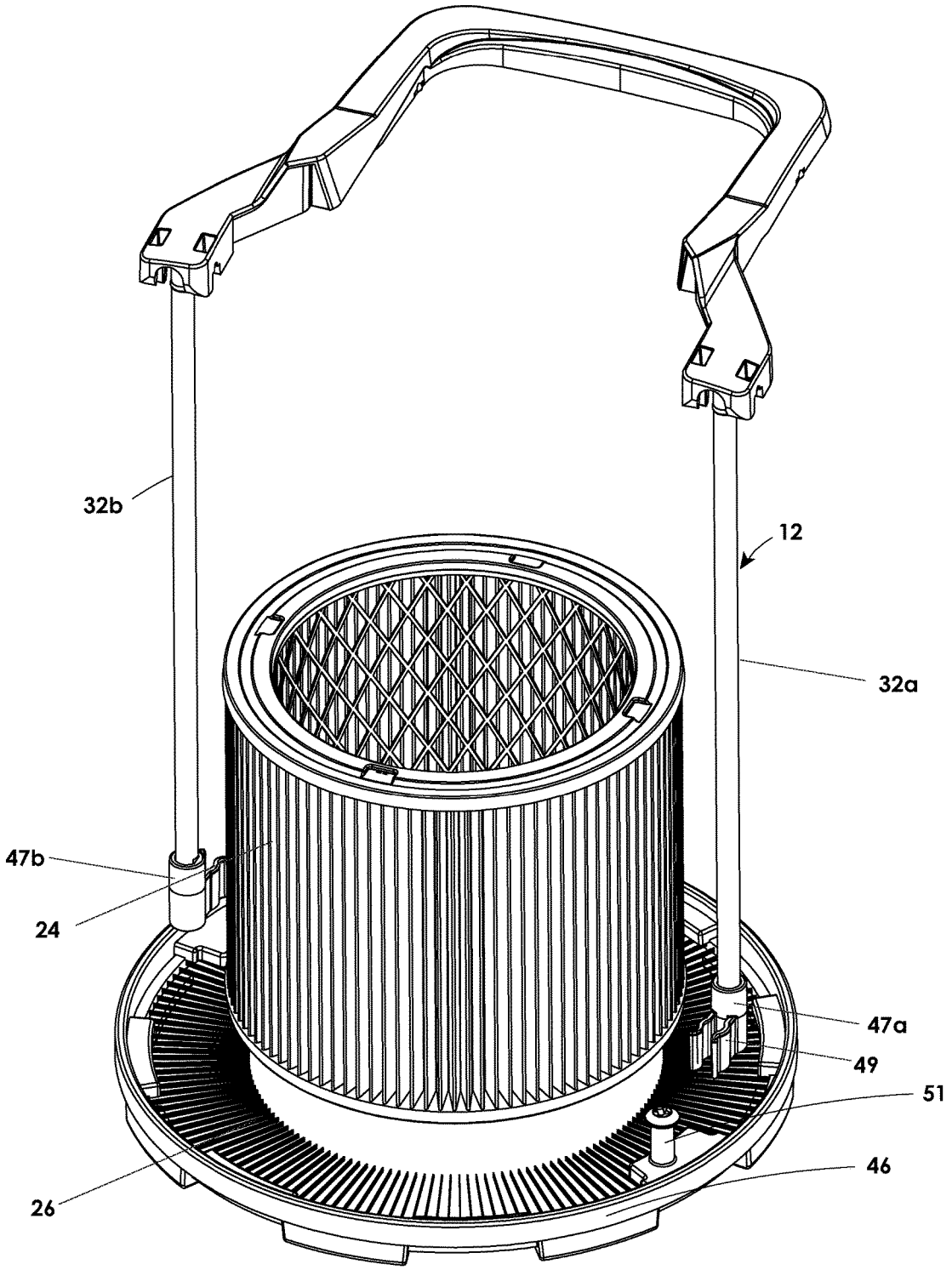
FIG. 9B is an isometric view of the filter cleaning mechanism of FIG. 9A in a disconnected configuration.

FIGS. 9A and 9B depict a filter cleaning mechanism 12 having rods 32*a* and 32*b* connectable to a filter brush holder 46 by rod retainers 47*a* and 47*b* respectively. In the connected configuration depicted in FIG. 9A, the rods 32*a* and 32*b* are connected to filter brush holder 46 by rod retainers 47*a* and *b* respectively. The rod retainers 47*a* and 47*b* include clamping arms 49 that connect to an outer surface of the projection 51 of the brush holder 46 at a curved portion that is complementary to the side of the projection 51. If the filter brush holder 46 is rotated around the filter 24, the clamping arms 49 of the filter brush holder 46 are disengaged from the projections 51 of the rod retainers 47*a* and 47*b*, resulting in the disconnected configuration depicted in FIG. 9B. If desirable, the filter brush 26 can be disengaged from the filter brush holder 46 after the filter brush holder 46 is disconnected from the rod retainers 47*a* and 47*b* for cleaning. A rod retainer 47 may be used in conjunction with any of the embodiments discussed above. While particular arrangements of the present invention have been illustrated and described, it would be appreciated to those skilled in the art that various other changes and modifications can be made without departing from the spirit of the invention. It is therefore intended to cover in the appended claims all such changes and modifications.

What is claimed is:

1. A vacuum cleaner having a filter cleaning mechanism, comprising:
   - a housing having an exterior side and an interior side, and a channel extending through the housing from the exterior side to the interior side;
   - a vacuum pump to draw air into the interior side of the housing;
   - a vacuum filter disposed on the interior side of the housing to filter the air;
   - a filter brush contacting a side of the vacuum filter;
   - a rod extending slidably through the channel and coupled to the filter brush; and
   - a handle coupled to the rod, wherein movement of the handle slides the rod through the channel and moves the filter brush along the side of the vacuum filter to remove debris from the filter, wherein the handle rotates from a folded position against the exterior side of the housing to an upright position; and
   - wherein the handle comprises a cam to translate rotation of the handle into linear movement of the handle.

2. The vacuum cleaner of claim 1, further comprising a seal member that surrounds the rod, wherein the seal member forms a seal between the rod and the channel when the handle is in the folded position and the handle pulls the rod such that the seal is disposed outside of the channel when the handle is in the upright position.

3. The vacuum cleaner of claim 2, wherein the handle at least partly surrounds and protects the seal member when the handle is in the upright position.

4. The vacuum cleaner of claim 2, wherein the seal member comprises an o-ring.

5. The vacuum cleaner of claim 4,
   - wherein the handle covers the o-ring when the handle is in the upright position.

6. The vacuum cleaner of claim 4, wherein the seal between the rod and to seal the channel is formed between an interior side of the channel and the o-ring.

7. The vacuum cleaner of claim 1, wherein the housing includes a cover and a lid cage joined together.

8. The vacuum cleaner of claim 1, further comprising:
   - another rod extending slidably through the housing and coupled to the filter brush;
   - wherein the handle is coupled to each of the rods.

9. The vacuum cleaner of claim 1, further comprising:
   - a brush holder coupled to the filter brush and connected to the rod by a rod retainer, wherein the brush holder is configured to be disconnected from the rod retainer.

10. The vacuum cleaner of claim 9, wherein the brush holder is configured to be disconnected from the rod retainer by rotating the brush holder around the filter.

11. The vacuum cleaner of claim 1, further comprising:
   - a bellows surrounding the rod, the bellows compressible from an extended configuration to a compressed configuration;
   - wherein the linear movement of the rod through the channel moves the bellows between the extended configuration and the compressed configuration.

12. The vacuum cleaner of claim 11, wherein the linear movement of the rod through the channel in a first direction moves the bellows from the extended configuration to the compressed configuration and prevents the accumulation of debris on the rod.

13. The vacuum cleaner filter of claim 11, wherein the linear movement of the rod through the channel in a second direction moves the bellows from the compressed configuration to the extended configuration and sucks air from between the interior side of the housing and the vacuum filter.

14. The vacuum cleaner of claim 1 further comprising:

a rod wiper attached to a wiper holder attached to the interior side of the housing in the channel such that the linear movement of the rod through the channel cleans the rod;

wherein the rod wiper comprises felt.

15. The vacuum cleaner of claim 14, wherein the housing comprises a lid cage, wherein the wiper holder is attached to the lid cage.

* * * * *